US008632443B2

(12) United States Patent
Hauptmann

(10) Patent No.: US 8,632,443 B2
(45) Date of Patent: Jan. 21, 2014

(54) THERAPEUTIC-EXERCISE PILLOW AND METHODS OF USE

(76) Inventor: Martina E. Hauptmann, Denver, CO (US)

( * ) Notice: Subject to any disclaimer, the term of this patent is extended or adjusted under 35 U.S.C. 154(b) by 314 days.

(21) Appl. No.: 12/978,437

(22) Filed: Dec. 24, 2010

(65) Prior Publication Data

US 2012/0165167 A1 Jun. 28, 2012

(51) Int. Cl.
*A63B 21/00* (2006.01)

(52) U.S. Cl.
USPC ..... 482/130; 482/121

(58) Field of Classification Search
USPC ..... 482/130, 142, 121, 124
See application file for complete search history.

(56) References Cited

U.S. PATENT DOCUMENTS

| | | | | |
|---|---|---|---|---|
| 2,839,766 | A | 6/1958 | Hull | |
| 4,796,315 | A | 1/1989 | Crew | |
| 4,907,306 | A | 3/1990 | Nakaji | |
| 4,923,187 | A | 5/1990 | Mombrinie | |
| 4,944,059 | A | 7/1990 | Wall | |
| 4,969,222 | A | 11/1990 | Serola | |
| 5,090,695 | A * | 2/1992 | Ciolino | 482/142 |
| 5,274,846 | A * | 1/1994 | Kolsky | 2/460 |
| 5,566,682 | A | 10/1996 | Yavitz | |
| 5,647,829 | A * | 7/1997 | Rivas | 482/142 |
| 5,697,112 | A | 12/1997 | Colavito et al. | |
| 5,724,687 | A | 3/1998 | Kim | |
| 5,755,647 | A | 5/1998 | Watnik | |
| 5,933,890 | A | 8/1999 | Codd | |
| 6,045,178 | A | 4/2000 | Miller | |
| 6,070,585 | A | 6/2000 | Fery et al. | |
| 6,185,768 | B1 | 2/2001 | Schlechter | |
| 6,263,876 | B1 | 7/2001 | Butts | |
| 6,324,710 | B1 | 12/2001 | Hernandez et al. | |
| 6,629,324 | B1 | 10/2003 | Shapiro | |
| 6,675,417 | B2 | 1/2004 | Spector et al. | |
| D555,741 | S * | 11/2007 | Wachtfogel et al. | D21/686 |
| 7,353,551 | B2 | 4/2008 | Racovolis | |
| 7,452,313 | B2 | 11/2008 | Endelman | |
| 7,563,217 | B2 | 7/2009 | Endelman | |
| 7,627,916 | B1 | 12/2009 | Gielow | |
| 8,033,969 | B2 * | 10/2011 | Feltz | 482/142 |
| 2004/0107501 | A1 | 6/2004 | Kancilja | |
| 2005/0150051 | A1 | 7/2005 | Greenawalt | |
| 2006/0040803 | A1 | 2/2006 | Perez, Jr. | |
| 2006/0042012 | A1 | 3/2006 | Littlehorn | |
| 2006/0277684 | A1 | 12/2006 | Wassilefky | |
| 2008/0086818 | A1 | 4/2008 | Sramek et al. | |
| 2008/0115284 | A1 | 5/2008 | Hiatt | |
| 2010/0113231 | A1 | 5/2010 | Kopp | |
| 2011/0207587 | A1 * | 8/2011 | De La Rambelje | 482/140 |

* cited by examiner

*Primary Examiner* — Jerome W Donnelly
(74) *Attorney, Agent, or Firm* — Perkins Coie LLP

(57) ABSTRACT

A therapeutic-exercise pillow is disclosed that facilitates exercises to be performed for general health and fitness, particularly in embodiments that incorporate resistance bands for the user's arms and legs, in order to strengthen and tone the body of side lay, supine, and prone positions. In many embodiments, the overall shape of the therapeutic-exercise pillow resembles a teardrop that is flattened on one side (the side that is intended to rest on the floor), and has strategic internal foam/padding layering and placement to help support the lower abdominal regions of persons with physiological and/or medial limitations that otherwise preclude exercising such regions. In some embodiments, a plurality of adjustable exercise-resistance members for arms and/or legs are removably attached to the therapeutic-exercise pillow.

21 Claims, 9 Drawing Sheets

THERAPEUTIC-EXERCISE PILLOW AND METHODS OF USE

BACKGROUND

A regular exercise regimen is often recommended for people to promote better overall health and fitness. For those who are in relatively good physical shape and have no significant limitations for positioning their bodies, engaging in regular exercise is not much of an issue.

Physical therapy is a well established branch of medicine and is designed to help people with medical issues function at a higher level. This is accomplished through specifically prescribed exercises with certain contraindications for movement. For instance, individuals with osteoporosis may need to extend their spines more frequently and to avoid flexion of the spine. Conversely, individuals with stenosis of the spine may need to do more flexion exercise and avoid extension. Unfortunately, the dual diagnoses of both spinal stenosis and osteoporosis in an individual are not uncommon. For those individuals prescribing a regimen of abdominal strengthening and spinal extension exercises to be performed at home typically presents a challenge to physical therapists especially considering the lack of suitable and affordable exercise equipment available for in home use.

If an individual diagnosed with the dual diagnosis attempts to do traditional exercises, such as trunk crunches or sit-ups for abdominal strengthening, the flexion of the spine that will occur is contraindicated. The physical therapist will often prescribe spinal stabilization exercises for these individuals. The premise of spinal stabilization exercise is finding "neutral spine" (see the Terminology section in this disclosure, infra), and then maintaining that "neutral spine" in various positions during various activities. In one exercise used to stabilize and strengthen the spine a patient is directed to place his or her spine in a neutral position by laying in a supine position, and then move an arm and or leg away from the body. This movement causes a lever arm of force that challenges the maintenance of "neutral spine". By resisting and maintaining the "neutral spine" position during the exercise, the patient will improve his or her abdominal strength and postural awareness. However, It can be difficult for a patient to establish the "neutral spine" location when lying supine without additional support. Another exercise often prescribed for an individual with the aforementioned dual diagnoses this often prescribed exercise has the individual assume a prone position on a mat wherein he or she lifts and moves his or her arms, legs and/or trunk. This can be problematic as lifting an arm, leg and/or trunk while lying on a mat will often move his/her spine into extension which is also contraindicated. Essentially, when an individual having the dual diagnosis lies prone with his or her spine is close to neutral, tightness in the anterior hip muscles may place the lumbar spine in an initial state of extension. Any subsequent or additional movement upward as required in performing the stabilization exercise increases the extension moment at the spine. As with the first exercise, a support device may be required to help the individual maintain the neutral spine position and maximize the benefit of the exercise.

Therapy balls (also referred to as Swiss ball), arc barrels and half domes (such as a BOSU® manufactured by Bosu Fitness, LLC of Delaware) can be used to support and alter the start position of the spine to a slightly flexed position allowing the individual to lift his arm, leg, trunk to "neutral spine". However, there are shortcomings to the use of these devices.

Therapy balls typically comprise inflated spheres having elastomeric skins that are about 18-30 inches in diameter. The shortcoming of using a therapy ball to alter a person's start position is that it can create excessive pressure at the area of contact with a prone-lying individual secondary to the firmness of a fully inflated ball. Further due to the ball's shape, an individual may have difficulty achieving the supine or side-lying positions to perform basic stabilization exercise. Finally, a therapy ball is inherently unstable and can cause an individual to fall while exercising.

An arc barrel is a longitudinal partial cylinder (typically a half cylinder or less) that is of used in Pilates to help support persons performing various exercises. A typical arc barrel is short in height usually 6 inches in height making it difficult for people with stiffness in their spine, hips and/or knees to get down on the floor to exercise. Furthermore, arc barrels typically lack softness and conformability, as they are often constructed from wood covered only with vinyl and a thin layer of padding. When a person lies prone over an arc barrel the combination of excessive firmness, short height and symmetrical sloping angles (or arcs) creates unwanted pressure in sensitive areas of the abdomen often causing discomfort.

A half-dome (or BOSU® or fitness dome) is an inflated half-sphere that has a symmetrical shape and symmetrical sloping angles (arcs). A typical half-dome is short in height (often only about 12 inches) that also makes it difficult to use by individuals who suffer from stiffness in their spine, hips and/or knees and often have trouble getting down on the floor to exercise. Moreover, like an arc barrel, a typical half-dome virtually lacks any significant softness and conformability as it is meant to be used while fully inflated, and thus are very firm. The symmetrical configuration, short height and firmness can create a focal area of pressure against the sensitive abdominal region in the prone lying individual. Additionally, the half-dome (and for that matter, arc barrel) are produced with a "one-size-fits-all" mentality even though individuals have different torso lengths. These different torso lengths can make for a dramatically different exercise experience for the short-waisted individual compared to the long-waisted individual.

A support device is needed that better facilitates exercise by individuals with flexibility and/or medical issues of the type described above. Ideally, the improved support device would be inherently stable and decrease the pressure felt by the individual by providing a larger contact area or interface between the device and the individual during exercise.

DETAILED DESCRIPTION

Overview

Figure 1:
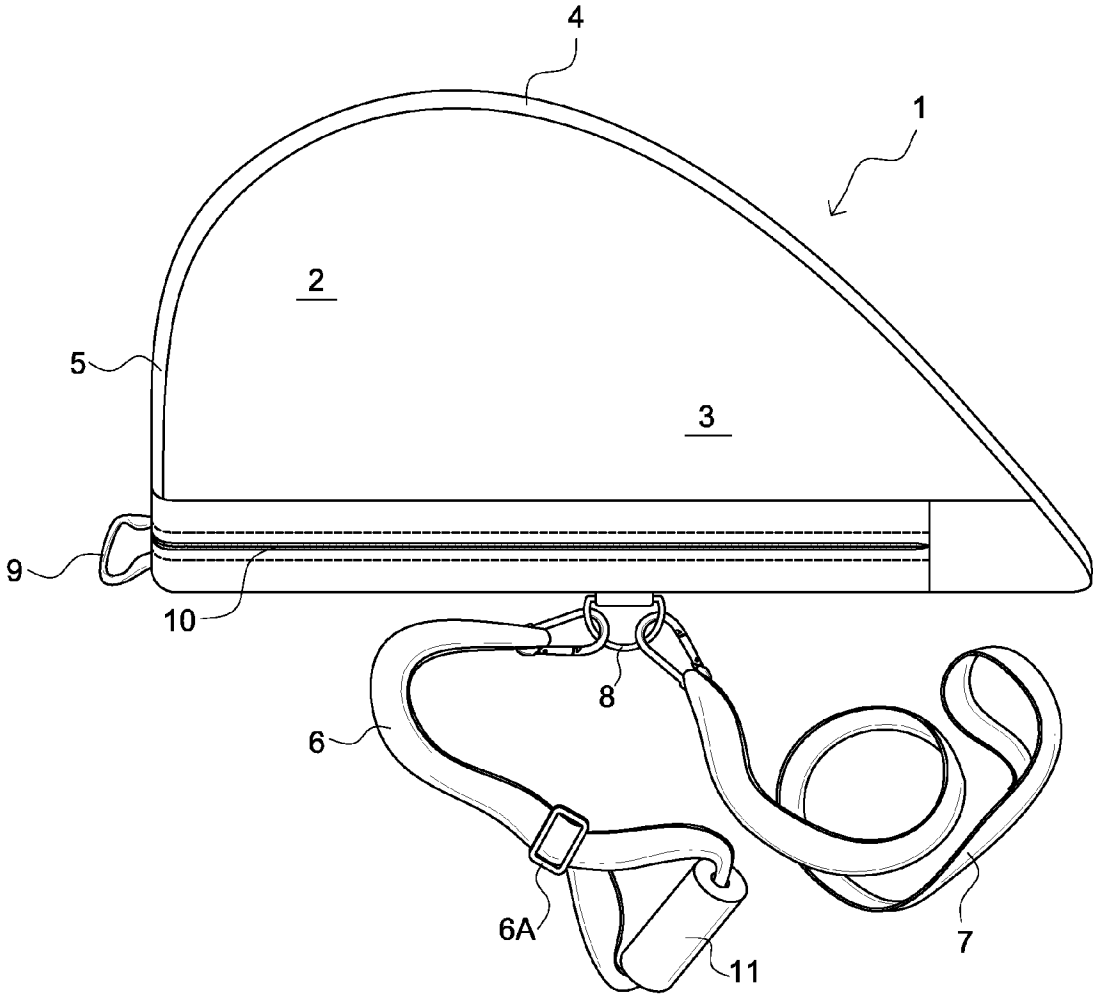
FIG. 1 depicts a side view of one embodiment of a therapeutic-exercise pillow.
Figure 2:
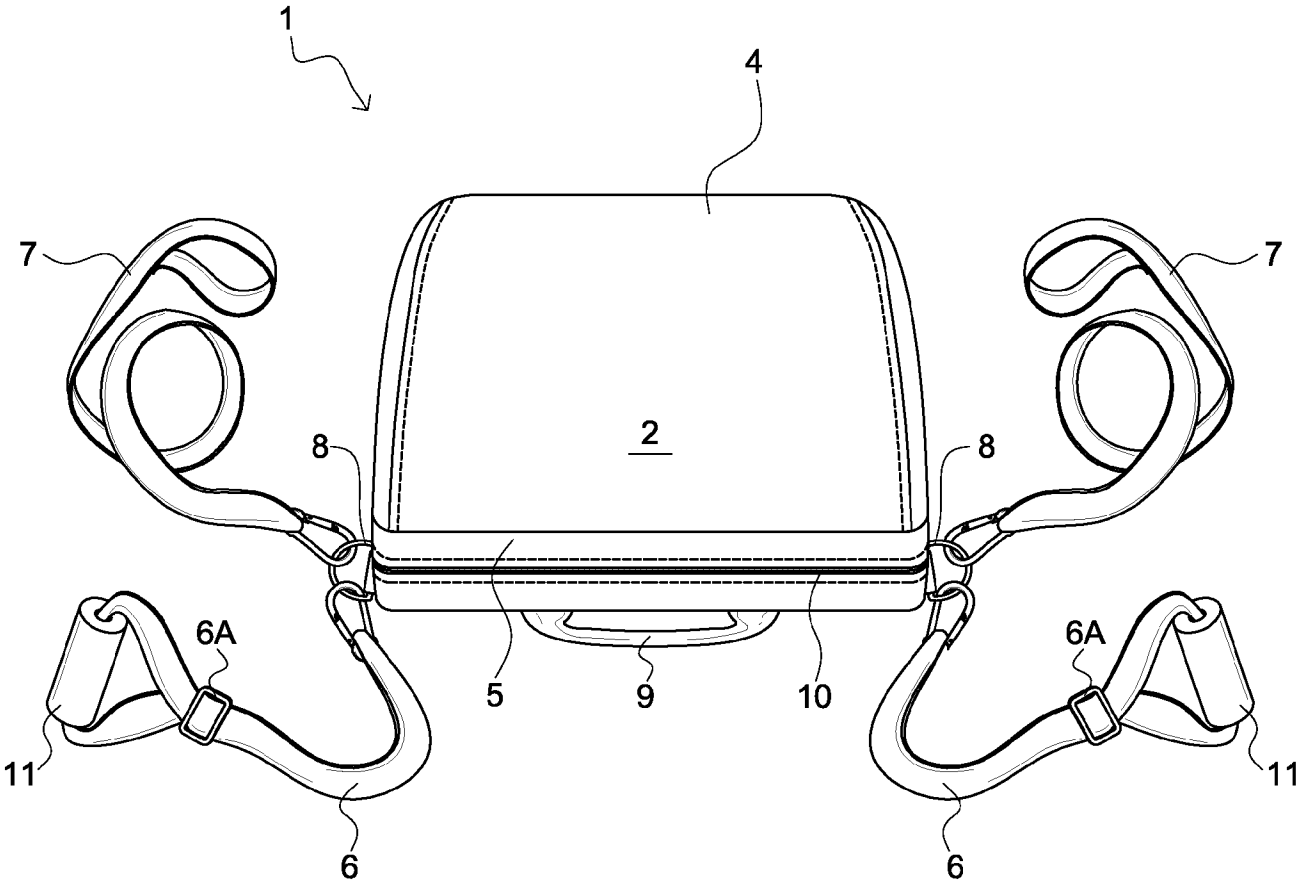
FIG. 2 depicts a front view of one embodiment of a therapeutic-exercise pillow.
Figure 3:
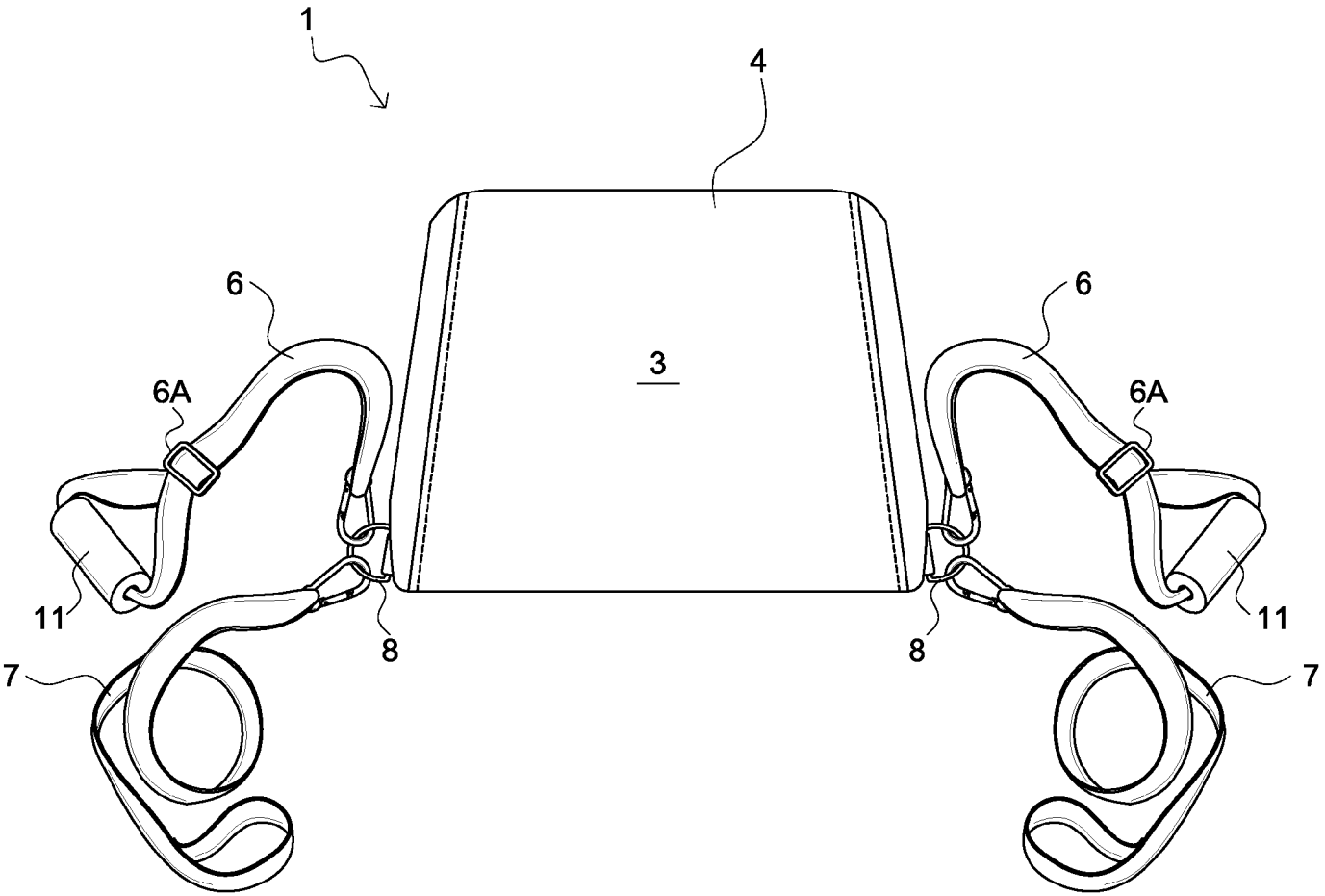
FIG. 3 depicts a rear view of one embodiment of a therapeutic-exercise pillow.
Figure 4:
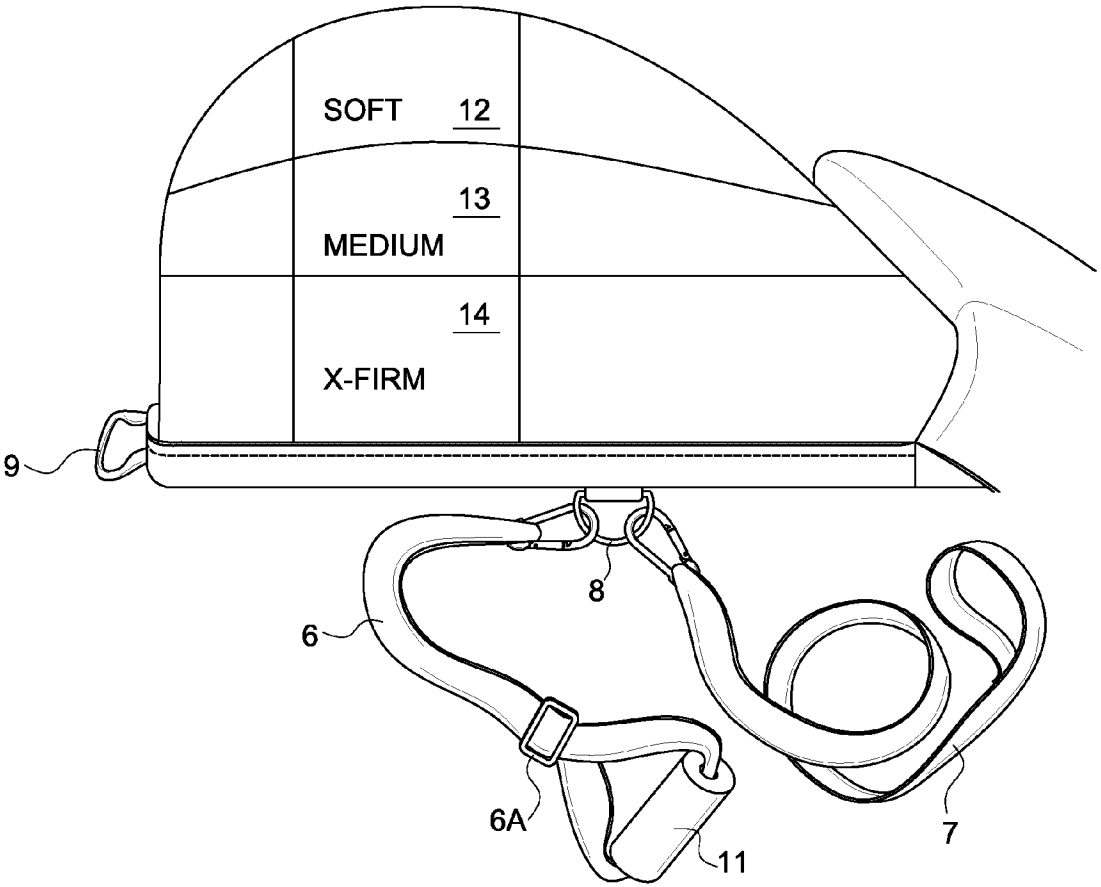
FIG. 4 depicts a side view of one embodiment of a therapeutic-exercise pillow, with the upper cover unzipped and pulled back to display the internal foam-layer structures.

The various embodiments of the invention encompass a therapeutic-exercise pillow that facilitates exercises to be performed for general health and fitness, particularly in embodiments that incorporate resistance bands for the user's arms and legs, in order to strengthen and tone the body of side-lay, supine, and prone positions. In most embodiments, the overall shape of the therapeutic-exercise pillow resembles a teardrop that is flattened on one side (the side that is intended to rest on the floor). In many embodiments, a plurality of adjustable exercise-resistance members/straps (e.g., Thera-Bands®) are removably attached and can be used to facilitate effective arm and leg exercises.

A key aspect to the therapeutic-exercise pillow in many embodiments is the strategic shape of the pillow, as well as the strategic layering of varying polyurethane-foam densities with varied Indention Load Deflection (IDL) ratings. This strategic design of the foam placements provides enhanced support for a user's lower abdominal area in order to enable a user to lay on his or her stomach more comfortably when various physiological and/or medical conditions make doing so normally difficult for the user. It does so by decreasing the tension in a user's lumbar region by supporting the lower-abdominal region.

In a typical embodiment, the pillow has a thick bottom foam layer with a density of approximately 1.8 lbm/ft$^3$ (also expressed in U.S. industry as pounds per cubic foot (PCF)) and an IDL rating of 65, a middle foam layer with a density of approximately 1.8 PCF and an IDL rating of 35, and a top foam layer with a with a density of approximately 1.8 PCF and an IDL rating of 25. Some variances on these foam densities and IDL ratings are permitted, but the firmer foam layers are progressively disposed toward the bottom of the pillow. Further, the shell or skin of the pillow is comprised of marine vinyl, stretch vinyl, leather, or, less preferably, some sort of cloth; and is further lined in some embodiments with a thin layer (e.g., ¼ inches) of foam plus pad. Stretch vinyl is particularly suitable because it is relatively inexpensive and helps the pillow maintain its semi-tear-drop shape. In some variations, the pillow may have some supplemental poly fill to fill any internal voids and help provide further support for the user's body.

In many embodiments, the therapeutic-exercise pillow has an easy-access means to the pillow internal structure, such as a long zipper that extends from one lateral side, across the bottom-front, and along the other lateral side. Other embodiments may use other easy-access means such as mechanical snaps or hook-and-loop (i.e., Velcro®) strips. In still more embodiments, the bottom-front of the interior of the pillow, near the zippered opening, is disposed a rigid or even semi-rigid cavity for convenient storage of therapeutic-exercise equipment; e.g., towels, oils, resistance straps, etc. This cavity can be shaped in myriad ways and still be effective; e.g., a rectangular box, or a concaved shell. Moreover, the cavity can be comprised of any number of materials, but in most cases would be made of a hard plastic to keep both the weight and manufacturing costs down, though in some variations, the cavity can be simply formed with a placement of firm foam.

Finally, the various embodiments of the therapeutic-exercise pillow can be scaled up or down in size to meet various practical application needs, such as sizing to meet the torso length of a given user. In one exemplary embodiment, for example, the bottom of the therapeutic-exercise pillow is 24.5" in length, 17" in width, and has a bottom foam layer that is 5" in height. That same exemplary embodiment has a middle layer of foam that is a flat ovoid shape, 21" in length, 15" in width, with varying heights including the highest point of 3.5" (located approximately 8" from the front of the pillow). Moreover, that same exemplary embodiment's top layer of foam is a concaved, ovoid shape that is 20" in length, 15" in width, with varying heights, including a maximum height of 5" located at approximately 8" form the front of the pillow.

Terminology

The terms and phrases as indicated in quotes (" ") in this section are intended to have the meaning ascribed to them in this Terminology section applied to them throughout this document, including the claims, unless clearly indicated otherwise in context. Further, as applicable, the stated definitions are to apply, regardless of the word or phrase's case, to the singular and plural variations of the defined word or phrase.

The term "or", as used in this specification and the appended claims, is not meant to be exclusive; rather, the term is inclusive, meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of the phrase "in one embodiment" and/or "in one variation" in various places in the specification are not necessarily all meant to refer to the same embodiment.

The term "couple" or "coupled", as used in this specification and the appended claims, refers to either an indirect or a direct connection between the identified elements, components, or objects. Often the manner of the coupling will be related specifically to the manner in which the two coupled elements interact.

The term "removable", "removably coupled", "readily removable", "readily detachable", and similar terms, as used in this patent application specification (including the claims and drawings), refer to structures that can be uncoupled from an adjoining structure with relative ease (i.e., non-destructively and without a complicated or time-consuming process) and can also be readily reattached or coupled to the previously adjoining structure.

Directional and/or relational terms such as, but not limited to, left, right, nadir, apex, top, bottom, vertical, horizontal, back, front, and lateral are relative to each other, are dependent on the specific orientation of an applicable element or article, are used accordingly to aid in the description of the various embodiments, and are not necessarily intended to be construed as limiting.

As applicable, the terms "about" and "generally" as used herein unless otherwise indicated means a margin of ±20%. Also, as applicable, the term "substantially" as used herein unless otherwise indicated means a margin of ±10%. It is to be appreciated that not all uses of the above terms are quantifiable such that the referenced ranges can be applied.

The terms "pillow", "exercise pillow", and "therapeutic-exercise pillow", and similar term, as used in this patent application specification (including the claims and drawings), refers to any type of pliable device used to support a user's body weight, or part of a user's body weight, with some padding or cushioning capability in order to reduce the impact and stress on the user's body while exercising.

The term "skewed-tear-drop shaped", as used in this patent application specification (including the claims and drawings), refers to the substantial general shape of the therapeutic-exercise pillow of the present inventive disclosure, wherein when viewed from a side profile, the pillow is substantially "tear-drop" shaped, with the exception that the side of the pillow that is designed to rest on the floor is generally flat. In other words, the "tear-drop" shape of the side profile of the pillow looks like one side has been partially shaved off such that the "tear drop" shape is no longer symmetrical. The amount of this asymmetry on the skewed-tear-drop shape can vary from one embodiment to the other.

The term "neutral-spinal position", as used in this patent application specification (including the claims and drawings), refers to an ideal user's spinal position during exercise. The proper posture of the "neutral spine" is the proper alignment of the body between postural extremes. In its natural alignment, the spine is not straight; rather, it has curves in the thoracic (upper) and lumbar (lower) regions. There is a slight forward curve in the lumbar region (lordosis), a slight backward curve in the thoracic region (kyphosis), and a slight extension in the cervical vertebra at the top of the spine. In addition, the ears, shoulders, hips, knees, and ankles are aligned as if a plumb line were running from the ears down through the torso into the legs and the feet. According to many physical therapists and others ordinarily skilled in the art, when in a neutral-spine position, the body is able to function in its most-balanced position, and the stress on the joints, muscles, vertebrae, and tissue is minimized. To maintain such a position, a supporting device such as a therapeutic-exercise pillow is often required in order to minimize the stress or tension on the user's body while maintaining such a spinal position.

First Embodiment

A Therapeutic-Exercise Pillow

This embodiment is directed generally to a therapeutic-exercise pillow or cushion device to facilitate exercises largely directed to helping minimizing tension and misalignment in muscular-skeletal structures while exercising.

Refer to FIGS. 1-4. In a typical embodiment, the therapeutic-exercise pillow 1 comprises a first region 2 comprising a rounded and convex upper surface 4, wherein the apex of the first region 2 represents the vertically highest point on the pillow, and a second region 3 coupled to the first region 2 and having an upper surface sloping down from the first region 2 toward the ground or floor, wherein the lateral profile of the coupled first and second regions 2, 3 is substantially shaped like a skewed tear drop resting on its side. The material used on the surfaces, in many embodiments, is comprised of marine vinyl, stretch vinyl, leather, or, less preferably, some sort of cloth; and is further lined in some variations with a thin layer (e.g., ¼ inches) of foam plus pad. Stretch vinyl is particularly suitable because it is relatively inexpensive and helps the pillow maintain its semi-tear-drop shape.

In addition, in some typical embodiments, the pillow has an inner volume, which can be viewed as divided in differently shaped and formed layers of polyurethane foam. These foam layers 12, 13, 14 in some embodiments, comprise a plurality of strategically shaped support foam placements 12, 13, 14 adapted to support a user's torso during therapeutic exercises, wherein the plurality of support foam placements 12, 13, 14 includes at least a first foam placement 14, a second foam placement 13, and a third foam placement 12. The first foam placement 14 is substantially made from a material of equal to or higher density than that of the second foam placement 13 and the third foam placement 12, wherein the first foam placement 14 has a higher Indention Load Deflection rating than that of the second foam placement 13 and the third foam placement 12, and the second foam placement 13 is substantially made from a material of equal to or higher density than that of the third foam placement 12, and the second foam placement 13 has a higher Indention Load Deflection rating than that of the third foam placement 12. In most embodiments, the first foam placement 14 is disposed below the second foam placement 13 and the third foam placement 12, and the second foam placement 13 is disposed between the first foam placement 14 and the third foam placement 12.

A key aspect to the therapeutic-exercise pillow 1 in many embodiments is the strategic shape of the pillow 1, as well as the strategic layering 12, 13, 14 of varying polyurethane-foam densities with varied Indention Load Deflection (IDL) ratings. This strategic design of the foam placements 12, 13, 14 provides enhanced support for a user's lower abdominal area in order to enable a user to lay on his or her stomach more comfortably when various physiological and/or medical conditions make doing so normally difficult for the user. It does this by decreasing the tension in a user's lumbar spine. In a typical embodiment, the pillow 1 has a thick bottom foam layer 14 with a density of approximately 1.8 $lbm/ft^3$ (also expressed in U.S. industry as pounds per cubic foot (PCF)) and an IDL rating of 65, a middle foam layer 13 with a density of approximately 1.8 PCF and an IDL rating of 35, and a top foam layer 12 with a with a density of approximately 1.8 PCF and an IDL rating of 25. Some variances on these foam densities and IDL ratings are permitted to allow for user preferences and/or comfort, as well as the intended exercise regimens. However, in all cases, the firmer foam layers 12, 13, 14 are progressively disposed toward the bottom of the pillow 1.

In one exemplary embodiment, the first layer of foam 14 is of type #1865, manufactured by Active Foam Products, Inc. of Eastpointe, Mich. In that same embodiment, the second layer of foam 13 is of type #1835, also manufactured by Active foam Products, Inc. finally, that same embodiment uses foam type #1825, also manufactured by Active foam Products, Inc., for the third layer of foam 12.

Further, the shell or skin of the pillow 2, 3, 4, 5 is comprised of marine vinyl, stretch vinyl, leather, or, less preferably, some sort of cloth; and is further lined in some embodiments with a thin layer (e.g., ¼ inches, and preferably within the range of ⅛ inches and ½ inches) of foam plus pad (not shown in the figures). Stretch vinyl is particularly suitable because it is relatively inexpensive and helps the pillow 1 maintain its semi-tear-drop shape. In some variations, the pillow 1 may have some supplemental poly fill to fill any internal voids and help provide further support for the user's body. However, if any supplemental poly fill is used, it is advisable to also have supplemental poly-fill-containing bags/structures within the pillow 1 so that the poly fill does not uncontrollably fall out when the interior of the pillow 1 is accessed and so that the pillow 1 can better keep its shape as it is used and/or moved.

In some embodiments, the therapeutic-exercise pillow 1 has a convenient access means 10 to the inner volume of the pillow 1, which allows for a user to access the foam layers and make changes to the padding structures 12, 13, 14 for customized uses. Typically, the access means 10 is disposed to span along the bottom of the pillow 1 from one lateral side of the therapeutic-exercise pillow 1, across the front 5 of the first region 2, and to the other lateral side of the therapeutic-exercise pillow 1. Some embodiments of the therapeutic-exercise pillow 1 have an access means 10 that can be a plurality of mechanical snaps, one or more hook-and-loop strips (e.g., Velcro®), or a simple zipper. In one embodiment, a zipper 10 with a total length of approximately 60 inches is used, though the appropriate length will depend on the overall size of the therapeutic-exercise pillow 1.

In still more embodiments, the bottom-front of the interior of the therapeutic-exercise pillow 1, near the zippered opening 10, is disposed an installed cavity (not shown in the figures) within the structure of the first foam placement 14 at the bottom of the interior of the therapeutic-exercise pillow 1, wherein the cavity is adapted for storage of therapeutic-exercise-related supplies such as towels, oils, resistance-exercise straps, etc. This cavity can be shaped in myriad ways and still be effective; e.g., a rectangular box, or a concaved shell. Moreover, the cavity can be made of any number of materials, but in most cases would be made of a hard plastic to keep both the weight and manufacturing costs down.

In yet another optional feature of this embodiment, a convenient carrying handle 9 is installed on the cover of the therapeutic-exercise pillow 1, which is typically installed at the bottom-front 5 of the pillow 1. This handle 9 can be installed at a variety of heights, relative to the bottom of the therapeutic-exercise pillow 1, and still be effective. The handle 9 also provides a convenient place for a user to temporarily tie-down any attached resistance-exercise members/bands 6, 7 during transport so that they are not tripped over.

To enhance the exercise options for the therapeutic-exercise pillow 1, many embodiments comprise an attachment means 8 on each lateral side of the therapeutic-exercise pillow 1 for removably attaching resistance-exercise members 6, 6A, 11, 7, such as, for example only, Thera-Bands®. In various embodiments, this attachment means 8 can be a "D" ring, a "hook" patch of a hook-and-loop fastener, a "loop" part of a hook-and-loop fastener, a "male" member of a mechanical snap, a "female" member of a mechanical snap, a tension lock, a slip lock, or a buckle. In many variations, each attachment means 8 is coupled to the therapeutic-exercise pillow 1 by a segment polypropylene nylon webbing sewn into the seams of the therapeutic-exercise pillow 1. In other variations, resistance-exercise members/straps 6, 7 can be simply attached to the therapeutic-exercise pillow 1 by merely tying an end of a strap to the attachment member 8; e.g., tying one or more straps to a "D" ring.

In most cases, the resistance-exercise members/straps 6, 6A, 11, 7 to be used with the attachment means 8 are designed to be detachably coupled to the attachment means 8 according to the type of attachment means 8. For example, if the attachment means 8 is a "hook" patch of a hook-and-loop fastener, then the resistance-exercise members 6, 7 to be attached would necessarily use a "loop" part of a hook-and-loop fastener to mate with the attachment means 8, and vice versa. Similarly, if the attachment means 8 is a "male" member of a mechanical snap, then it necessarily must mate with a "female" member of a mechanical snap at one end of a resistance-exercise member/strap 6, 7, and vice versa. It should be noted that in one preferred embodiment, there is a single pair of attachment means 8; however, it should be appreciated that it is envisioned that in other embodiments, additional attachment means 8 can be added to the therapeutic-exercise pillow 1. For example, a second pair of attachment means 8 can be installed at the lower rear corners of the therapeutic-exercise pillow 1 to provide an alternate place to couple resistant leg-exercise members/straps 7. Of course, in still more embodiments, the resistance-exercise members/straps 6, 7 can be fixedly sewn into the seams of the therapeutic-exercise pillow 1 and thus are not detachably coupled.

In many embodiments, the therapeutic-exercise pillow 1 further comprises a pair of resistant arm-exercise members 6, 6A, 11, wherein each resistant arm-exercise member 6, 6A, 11 is comprised of an elongated flexible material, each resistant arm-exercise member 6, 6A, 11 is removably attached to the attachment means 8, and each resistant arm-exercise member 6, 6A, 11 has a gripping means 11 adapted to allow a user to substantially secure the user's hand and/or wrist in order to facilitate resistance exercises using the user's corresponding arm. In variations, the gripping means 11 includes an adjustment means 6A to allow a user to customizably adapt the associated resistant arm-exercise member 6, 6A, 11 to a user's arm length and comfort level. In some embodiments, the adjustment means is a tension lock, which is known in the art, and facilitates the creation of a loop for engagement with a user's hand. In many variations of this embodiment, each of the pair of resistant arm-exercise members 6, 6A, 11 is elastic.

In yet other embodiments, the therapeutic-exercise pillow 1 further comprises a pair of resistant leg-exercise members 7, wherein each resistant leg-exercise member 7 is comprised of an elongated flexible material, each resistant leg-exercise member 7 is removably attached to said attachment means 8, and each resistant leg-exercise member 7 has a gripping means adapted to allow a user to substantially secure said user's foot and/or ankle in order to facilitate resistance exercises using said user's corresponding leg. In variations, the gripping means includes an adjustment means (not shown in the figures but similar to the adjustment means 6A) to allow a user to customizably adapt the associated resistant leg-exercise member 7 to a user's leg length and comfort level. In some embodiments, this adjustment means is a slip lock, which is known in the art. In many variations of this embodiment, each of the pair of resistant leg-exercise members 7 is elastic.

In the case of any resistance-exercise members 6, 7 attached to the attachment member 8, the attachment can be fixed in some embodiments, but in most embodiments the resistance-exercise members 6, 7 will be detachably coupled by way of some sort of mechanical clip device, mechanical snap, hook-and-loop fastening, or even the mere tying of one end of a strap of a given resistance-exercise member to the attachment means 8.

Overall, for most embodiments, the therapeutic-exercise pillow 1 is adapted to support the lower abdominal area of a user to minimize stress on the user's stomach, thereby creating a relatively tension-free starting position for the user's exercises by allowing a slightly flexed user-spine position, while ensuring correct alignment of a user's spine to minimize the chance of injury while exercising.

Second Embodiment

A Method of Making a Therapeutic-Exercise Pillow

This embodiment is directed generally to a method for making a therapeutic-exercise pillow. Refer to FIGS. 1-4. The method comprises the steps of:

Providing a first region 2 comprising a rounded, convex upper surface 4, wherein the apex of the first region 2 represents the vertically highest point on the therapeutic-exercise pillow 1;

Providing a second region 3 coupled to the first region 2 and having an upper surface sloping down from the first region 2 toward the ground, wherein the lateral profile of the coupled first and second regions 2, 3 is substantially shaped like a skewed tear drop resting on its side; and Providing an inner volume, including the first and second regions 2, 3, comprising a plurality of strategically shaped support foam placements 12, 13, 14 adapted to support a user's torso during therapeutic exercises, wherein the plurality of support foam placements 12, 13, 14 includes at least a first foam placement 14, a second foam placement 13, and a third foam placement 12. Further, the first foam placement 14 is substantially made from a material of equal to or higher density than that of the second foam placement 13 and the third foam placement 12; the first foam placement 14 has a higher Indention Load Deflection rating than that of the second foam placement 13 and said third foam placement 12; the second foam placement 13 is substantially made from a material of equal to or higher density than that of the third foam placement 12; the second foam placement 13 has a higher Indention Load Deflection rating than that of the third foam placement 12; the first foam placement 14 is disposed below the second foam placement 13 and the third foam placement 12; and the second foam placement 13 is disposed between the first foam placement 14 and the third foam placement 14.

This embodiment can be further enhanced wherein the density of each of the first, second, and third foam placements 14, 13, 12 is substantially 1.8 lbm/ft$^3$.

This embodiment can be further enhanced wherein the Indention Load Deflection rating for the first foam placement 14 is substantially 65, said Indention Load Deflection rating for the second foam placement 13 is substantially 35, and the Indention Load Deflection rating for the third foam placement 12 is substantially 25.

This embodiment can be further enhanced wherein the outer surfaces of the therapeutic-exercise pillow 1 are comprised of a material selected from the group consisting of marine-grade vinyl, stretch vinyl, leather, and cloth.

This embodiment can be enhanced by further comprising the step of providing an access means 8 to the inner volume, wherein the access means 8 is disposed to span from one lateral side of the therapeutic-exercise pillow 1, across the front 5 of the first region 2, and to the other lateral side of the therapeutic-exercise pillow 1. In variations, this access means 10 can be a plurality of mechanical snaps, hook-and-loop strips, or a zipper.

This embodiment can be enhanced by further comprising the step of providing a cavity (not shown in the figures), accessible via the access means 10, within the structure of said first foam placement 14 disposed at the bottom of the interior of the therapeutic-exercise pillow 1, wherein the cavity is adapted for storage of therapeutic-exercise-related supplies.

This embodiment can be enhanced by further comprising the step of providing a thin layer of foam padding (not shown in the figures) disposed adjacent to the interior side of the outer surfaces 5, 4, the thin layer being at a thickness between ⅛ inches and ½ inches.

This embodiment can be enhanced by further comprising the step of providing an attachment means 8 on each lateral side of the therapeutic-exercise pillow 1 for removably attaching resistant-exercise members 6, 7. In variations, each attachment means 8 for attaching resistant-exercise members 6, 7 is selected from the group consisting of a "D" ring, a "hook" patch of a hook-and-loop fastener, a "loop" part of a hook-and-loop fastener, a "male" member of a mechanical snap, a "female" member of a mechanical snap, a tension lock, a slip lock, and a buckle.

This embodiment can be enhanced by further comprising the step of providing a pair of resistant arm-exercise members 6, 6A, 11, wherein each resistant arm-exercise member 6, 6A, 11 is comprised of an elongated flexible material, each resistant arm-exercise member 6, 6A, 11 is removably attached to the attachment means 8, and each resistant arm-exercise member 6, 6A, 11 has a gripping means 11 adapted to allow a user to substantially secure the user's hand and/or wrist in order to facilitate resistance exercises using the user's corresponding arm. In some variations, the gripping means 11 includes an adjustment means 6A to allow a user to customizably adapt the associated resistant arm-exercise member 6, 6A, 11 to a user's arm length and comfort level. In many embodiments, each of the pair of resistant arm-exercise members 6, 6A, 11 is elastic.

This embodiment can be enhanced by further comprising the step of providing a pair of resistant leg-exercise members 7, wherein each resistant leg-exercise member 7 is comprised of an elongated flexible material, each resistant leg-exercise member 7 is removably attached to the attachment means 8, and each resistant leg-exercise member 7 has a gripping means adapted to allow a user to substantially secure a user's foot and/or ankle in order to facilitate resistance exercises using a user's corresponding leg. In some variations, the gripping means includes an adjustment means (not specifically shown in the figures but similar to adjustment means 6A) to allow a user to customizably adapt the associated resistant leg-exercise member 7 to a user's leg length and comfort level. In many embodiments, each of the pair of resistant leg-exercise members 7 is elastic.

This embodiment can be enhanced wherein in the case of any resistance-exercise members 6, 7 attached to the attachment member 8, the attachment can be fixed in some embodiments, but in most embodiments the resistance-exercise members 6, 7 will be detachably coupled by way of some sort of mechanical clip device, mechanical snap, hook-and-loop fastening, or even the mere tying of one end of a strap of a given resistance-exercise member to the attachment means 8.

This embodiment can be further enhanced wherein the therapeutic-exercise pillow 1 is adapted to support the lower abdominal area of a user to minimize stress on the user's stomach, thereby creating a relatively tension-free starting position for the user's exercises by allowing a slightly flexed user-spine position, while ensuring correct alignment of a user's spine to minimize the chance of injury while exercising.

Third Embodiment

Methods for Using a Therapeutic-Exercise Pillow

Referring to FIGS. 5-9, this embodiment is directed generally to various methods of using a therapeutic-exercise pillow according to the First Embodiment, discussed supra.

Figure 5:
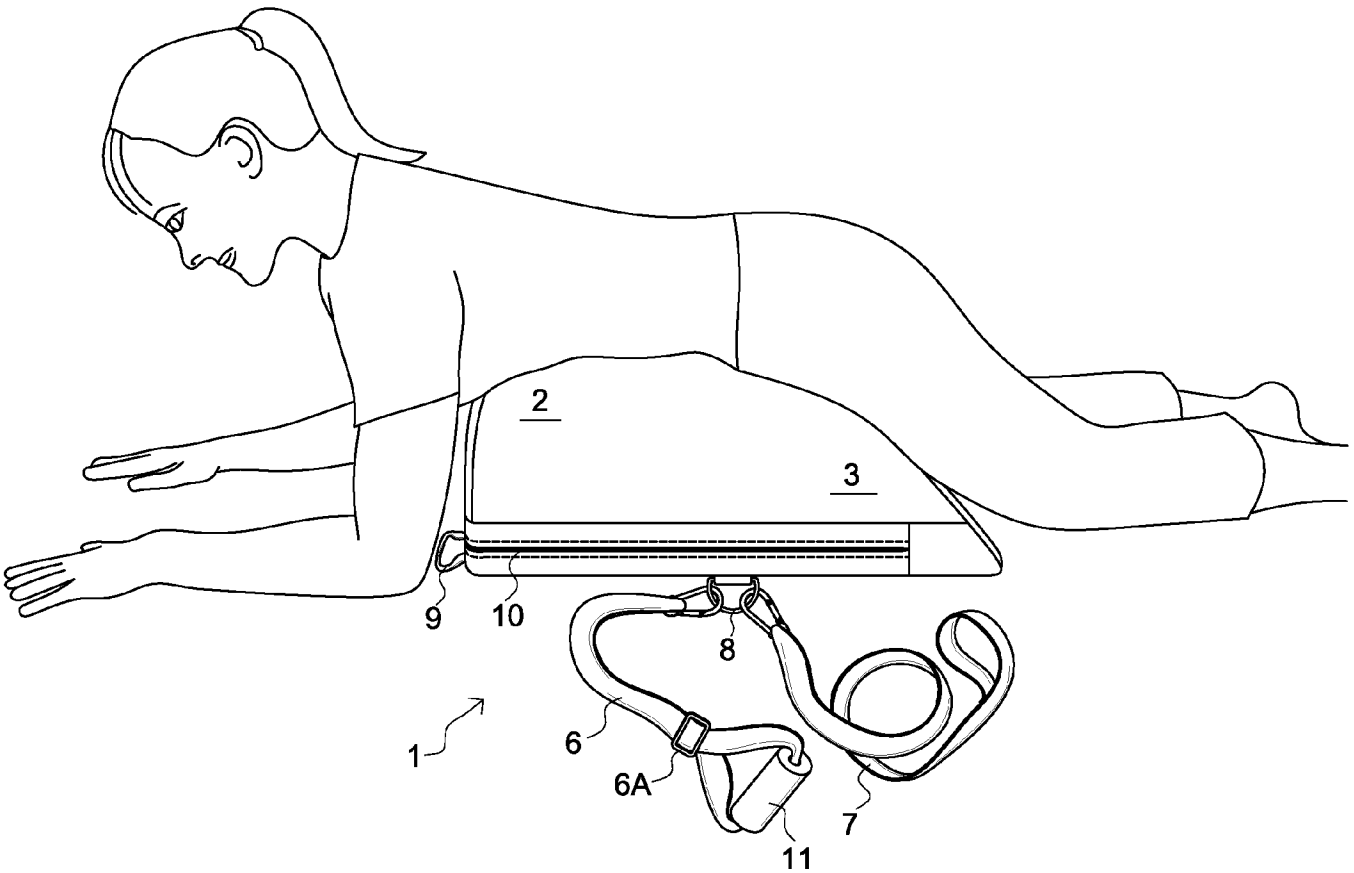
FIG. 5 depicts one embodiment of the use of a therapeutic-exercise pillow by a person at the finish position of spinal extension to neutral, after the person had started with the head and chest in forward flexion over the pillow and then by primary use of spinal extensors lifted to the neutral-spine position. The person depicted is using slight pressure thru arms to maintain the neutral-spine position.

Refer to FIG. 5. In one variation, the method comprises the steps of:

Positioning the user's torso over the therapeutic-exercise pillow 1, wherein the user's upper chest is initially located above, and in contact with, the first region 2 of the therapeutic-exercise pillow 1, the user's abdomen is initially positioned above, and in contact with, the second region 3 of the therapeutic-exercise pillow 1, and the user is in forward flexion over the therapeutic-exercise pillow 1;

Using spinal extensors to lift the user's spine toward a neutral position; and

Establishing the user's final position of spinal extension to neutral.

Figure 9:
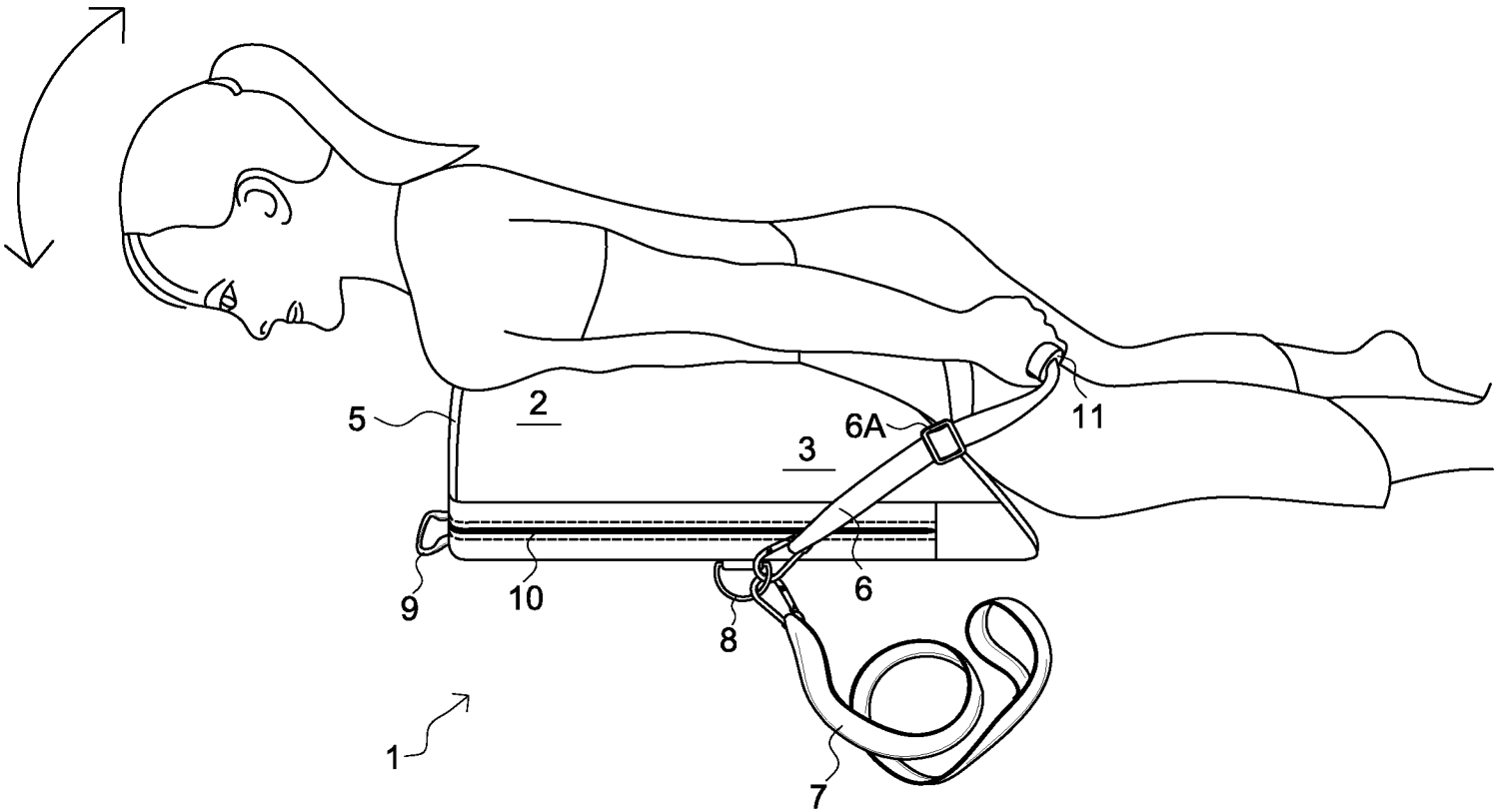
FIG. 9 depicts one embodiment of the use of a therapeutic-exercise pillow by a person engaging in a spinal-extension exercise to neutral with arm challenge of triceps extension, and employs a pair of resistant arm-exercise straps. This exercise can be performed unilaterally or bilaterally.

Refer to FIG. 9. This embodiment can be further enhanced by further comprising the steps of:

Engaging each of the user's arms with the side-associated resistant arm-exercise member 6, 6A, 11; and Substantially simultaneously with the step of using spinal extensors, using arm-challenge exercises with the resistant arm-exercise members 6, 6A, 11, wherein the user's triceps are subjected to extension.

Figure 7:
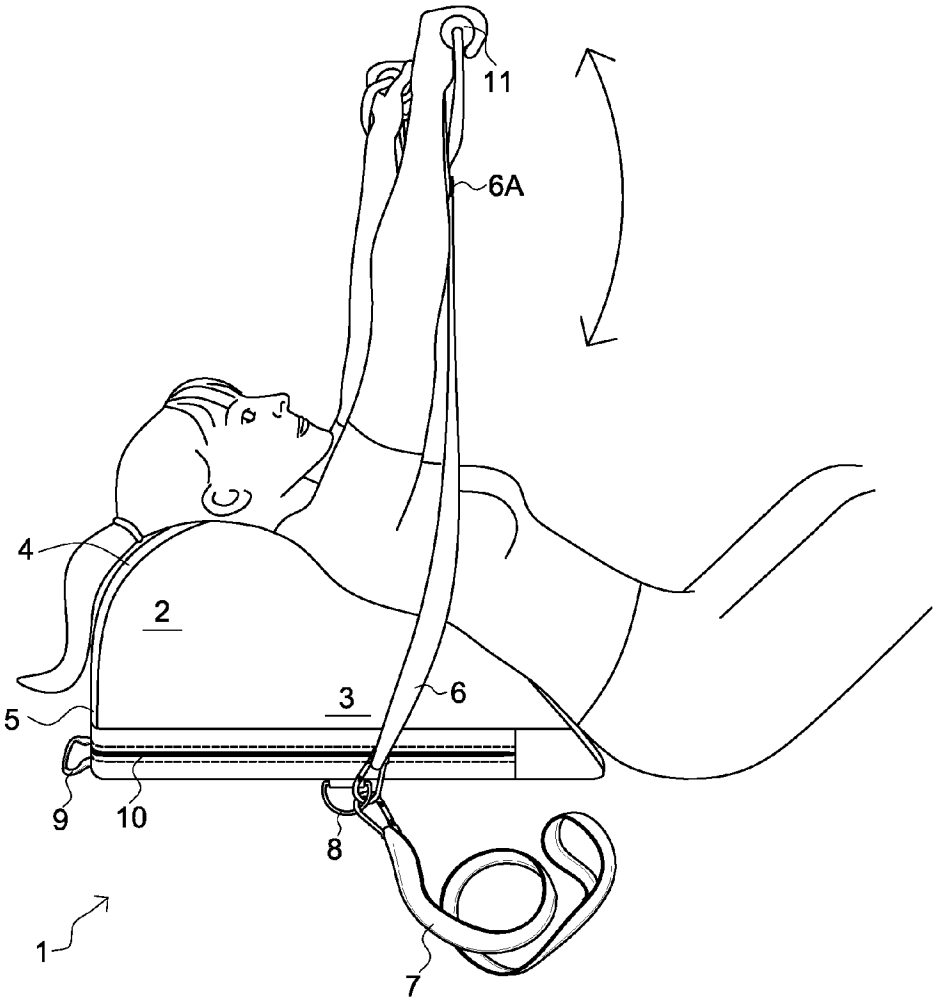
FIG. 7 depicts one embodiment of the use of a therapeutic-exercise pillow by a person engaging in a chest-press exercise employing a pair of resistant arm-exercise straps.

Refer to FIG. 7. This embodiment can be further enhanced by further comprising the steps of:

Positioning the user's head and back over the therapeutic-exercise pillow 1, wherein the user's head and upper back is located above, and in contact with, the first region 2 of the therapeutic-exercise pillow 1, the user's lower back is located above, and in contact with, the second region 3 of the therapeutic-exercise pillow 1, and whereby the user is in a substantially reclined position with respect to the therapeutic-exercise pillow 1;

Re-engaging each of the user's arms with the side-associated resistant arm-exercise member 6, 6A, 11; and Performing user-chest-press resistance exercises from the reclined position using the resistant arm-exercise members 6, 6A, 11.

Figure 6:
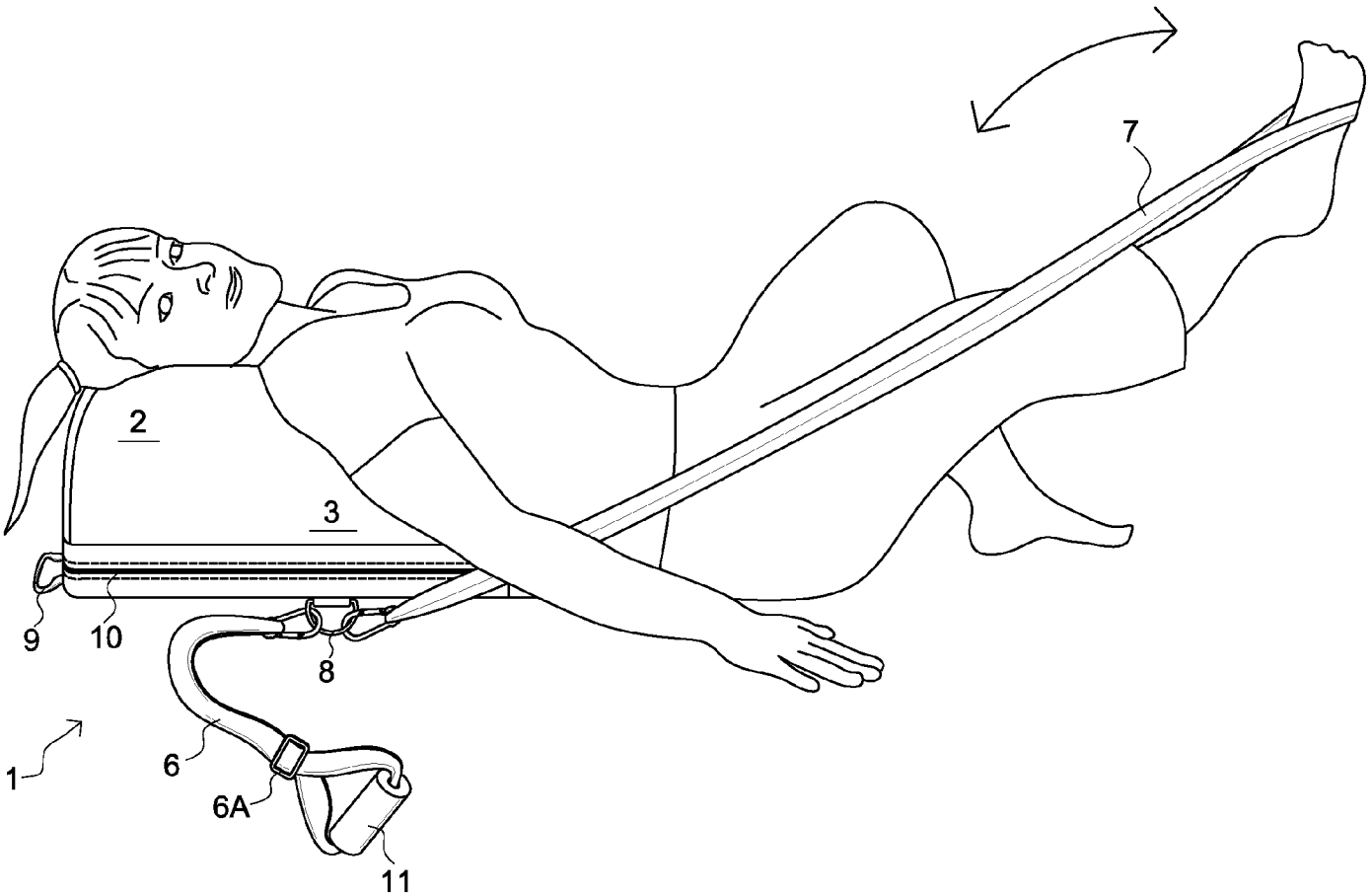
FIG. 6 depicts one embodiment of the use of a therapeutic-exercise pillow by a person using a single-leg extension from a flexed hip and knee position while maintaining spine in neutral, but with an incline of the person's trunk, employing a resistant leg-exercise strap. This position is helpful for individuals who do not tolerate laying flat on their back but need to have the head elevated over their heart for blood pressure issues or general orthopedic changes that have made the cervical and thoracic spine stiff.

Refer to FIG. 6. This embodiment can be further enhanced by further comprising the steps of:

Positioning the user's head and back over the therapeutic-exercise pillow 1, wherein the user's head and upper back is located above, and in contact with, the first region 2 of the therapeutic-exercise pillow 1, the user's lower back is located above, and in contact with, the second region 3 of the therapeutic-exercise pillow 1, and the user is in a substantially reclined position with respect to the therapeutic-exercise pillow 1;

Engaging at least one of the user's legs with the side-associated resistant leg-exercise member 7; and Performing user-leg-press resistance exercises from the reclined position using the resistant leg-exercise member 7 engaged with the at least one user leg.

Figure 8:
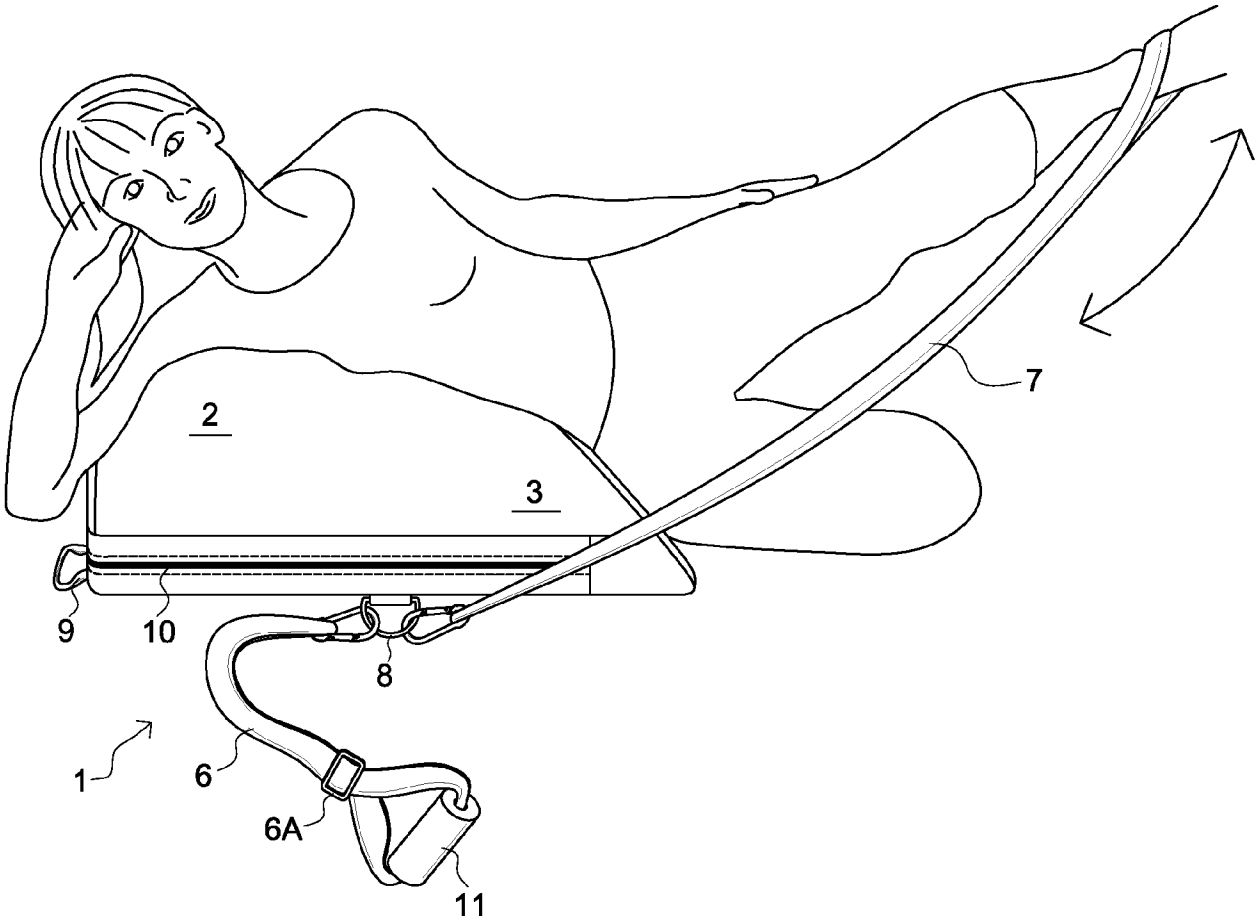
FIG. 8 depicts one embodiment of the use of a therapeutic-exercise pillow by a person engaging in a hip-abduction strengthening exercise employing a resistant leg-exercise strap.

Refer to FIG. 8. This embodiment can be further enhanced by further comprising the steps of:

Positioning the side of the user's torso over the therapeutic-exercise pillow 1, wherein the user's side ribcage is located above, and in contact with, the first region 2 of the therapeutic-exercise pillow 1, the user's lower side abdomen is located above, and in contact with, the second region 3 of the therapeutic-exercise pillow 1, and the user is in a substantially sideways reclined position with respect to the therapeutic-exercise pillow 1;

Engaging the user's leg on the opposite side as that in contact with the user's ribcage with the side-associated resistant leg-exercise member 7; and Performing user-leg-press resistance exercises using the resistant leg-exercise member 7 engaged with the at least one user leg.

Alternative Embodiments and Other Variations

The various embodiments and variations thereof described herein and/or illustrated in the accompanying figures are merely exemplary and are not meant to limit the scope of the inventive disclosure. It should be appreciated that numerous variations of the invention have been contemplated as would be obvious to one of ordinary skill in the art with the benefit of this disclosure.

Hence, those ordinarily skilled in the art will have no difficulty devising myriad obvious variations and improvements to the invention, all of which are intended to be encompassed within the scope of the claims which follow.

What is claimed is:

1. A therapeutic-exercise pillow, comprising:

padding defining a substantially flat bottom, a front sidewall extending from a front edge portion of the bottom, a rear sidewall extending from a rear edge portion of the bottom, and opposing lateral sidewalls extending between the front and rear sidewalls and extending from opposing lateral edge portions of the bottom, the front and rear sidewalls converging at an apex positioned between the front edge portion and a midpoint between the front edge portion and the rear edge portion, wherein the front and rear sidewalls define a convex surface oriented away from the bottom, and wherein the apex is defined by an uppermost portion of the convex surface, the front sidewall having a first continuously downward slope extending from the apex and terminating at the front edge portion of the bottom, the rear sidewall having a second continuously downward slope extending from the apex and terminating at the rear edge portion of the bottom, the first continuously downward slope being steeper than the second continuously downward slope; and a shell surrounding the padding.

2. The therapeutic-exercise pillow of claim 1, wherein the bottom has a substantially rectangular shape.

3. The therapeutic-exercise pillow of claim 1, further comprising a pair of resistant arm-exercise members removably coupled to the shell.

4. The therapeutic-exercise pillow of claim 3, wherein each resistant arm-exercise member has a grip, and wherein each resistant arm-exercise member is adjustable in length.

5. The therapeutic-exercise pillow of claim 3, wherein the pair of resistant arm-exercise members are elastic.

6. The therapeutic-exercise pillow of claim 1, further comprising a pair of resistant leg-exercise members removably coupled to the shell.

7. The therapeutic-exercise pillow of claim 6, wherein each resistant leg-exercise member has a grip, and wherein each resistant leg-exercise member is adjustable in length.

8. The therapeutic-exercise pillow of claim 6, wherein the pair of resistant leg-exercise members are elastic.

9. The therapeutic-exercise pillow of claim 1, further comprising a pair of resistant arm-exercise members and a pair of resistant leg-exercise members removably coupled to the shell.

10. The therapeutic-exercise pillow of claim 9, wherein one of the pair of resistant arm-exercise members and one of the pair of resistant leg-exercise members are coupled to the shell at a first common attachment point, and wherein the other of the pair of resistant arm-exercise members and the other of the pair of resistant leg-exercise members are coupled to the shell at a second common attachment point.

11. The therapeutic exercise pillow of claim 1, wherein the first and second common attachment points are located at an area where the lateral sidewalls meet the lateral edge portions of the bottom.

12. The therapeutic exercise pillow of claim 1, wherein the shell defines a closeable opening extending through the shell for providing access to the padding.

13. The therapeutic exercise pillow of claim 12, wherein the closeable opening spans from one of the lateral sidewalls of the padding across the front sidewall of the padding and to the other lateral sidewall of the padding.

14. The therapeutic-exercise pillow of claim 1, wherein the padding is a foam.

15. The therapeutic-exercise pillow of claim 1, wherein the padding includes multiple layers.

16. The therapeutic-exercise pillow of claim 1, wherein the lateral sidewalls converge from the bottom towards the apex.

17. The therapeutic-exercise pillow of claim 1, wherein the shell maintains the shape of the padding.

18. A therapeutic-exercise pillow, comprising:

padding defining a substantially flat bottom, the bottom having a substantially rectangular shape, a front sidewall extending from a front edge portion of the bottom, a rear sidewall extending from a rear edge portion of the bottom, and opposing lateral sidewalls extending between the front and rear sidewalls and extending from opposing lateral edge portions of the bottom, the front and rear sidewalls converging at an apex positioned between the front edge portion and a midpoint between the front edge portion and the rear edge portion, the front and rear sidewalls define a convex surface oriented away from the bottom, the apex defined by an uppermost portion of the convex surface, the front sidewall having a steeper slope than the rear sidewall, the lateral sidewalls converging from the bottom towards the apex;

a shell surrounding the padding;

a pair of resistant arm-exercise members removably coupled to the shell; and a pair of resistant leg-exercise members removably coupled to the shell, wherein one of the pair of resistant arm-exercise members and one of the pair of resistant leg-exercise members are coupled to the shell at a first common attachment point, and wherein the other of the pair of resistant arm-exercise members and the other of the pair of resistant leg-exercise members are coupled to the shell at a second common attachment point, wherein the first and second common attachment points are located on areas adjacent to where the lateral sidewalls meet the lateral edge portions of the bottom, wherein the first common attachment point is located at a midpoint between the rear edge portion and the front edge portion, wherein the second common attachment point is located at a midpoint between the rear edge portion and the front edge portion, wherein the padding is a foam.

19. A therapeutic-exercise pillow, comprising:

padding defining a substantially flat bottom surface, a front sidewall extending from a front edge portion of the bottom surface, a rear sidewall extending from a rear edge portion of the bottom surface, and opposing lateral sidewalls extending between the front and rear sidewalls and extending from opposing lateral edge portions of the bottom surface, the front and rear sidewalls converging at an apex positioned between the front edge portion and a midpoint between the front edge portion and the rear edge portion, wherein the front and rear sidewalls define a convex surface oriented away from the bottom surface, and wherein the apex is defined by an uppermost portion of the convex surface;

a shell surrounding the padding;

a first pair of resistant exercise members coupled to the shell; and a second pair of resistant exercise members coupled to the shell, wherein one of the pair of the first resistant exercise members and one of the pair of the second resistant exercise members are coupled to the shell at a first common attachment point, wherein the first common attachment point is located on the bottom surface adjacent to a first lateral edge portion;

wherein the other of the pair of the first resistant exercise members and the other of the pair of the second resistant exercise members are coupled to the shell at a second common attachment point, wherein the second common attachment point is located on the bottom surface adjacent to a second lateral edge portion.

20. The therapeutic-exercise pillow of claim 1, wherein the first continuously downward slope increases in magnitude as the front sidewall approaches the front edge portion.

21. The therapeutic-exercise pillow of claim 1, wherein the second continuously downward slope increases in magnitude as the rear sidewall approaches the rear edge portion.

* * * * *